United States Patent [19]

Fulop

[11] 4,038,720

[45] Aug. 2, 1977

[54] GARBAGE CAN COVER SPRING CLOSURE

[76] Inventor: Laszlo Fulop, 139-06 253rd St., Rosedale, N.Y. 11422

[21] Appl. No.: 672,646

[22] Filed: Apr. 1, 1976

[51] Int. Cl.[2] ..... E05D 11/10

[52] U.S. Cl. ..... 16/145; 220/264

[58] Field of Search ..... 220/263, 264; 16/145, 16/158, 180, 182, 187, 188

[56] References Cited

U.S. PATENT DOCUMENTS

| | | | |
|---|---|---|---|
| 2,328,833 | 9/1943 | Moon et al. | 220/264 |
| 2,639,113 | 5/1953 | Kriz | 220/264 X |
| 3,389,826 | 6/1968 | Wall | 220/264 |

*Primary Examiner*—G. V. Larkin

[57] ABSTRACT

The present invention provides an attachment for securing a garbage can cover to a garbage can. The garbage can cover has a peripheral lip portion to which is secured one end of a first elongated plate. The garbage can has a basewall and a sidewall extending upwardly therefrom that defines an open end to which is secured one end of a second elongated plate. The other end of each of the two plates is hingedly secured to each other and spring means extending between the two plates are also provided in order to selectively urge the garbage can cover to a first closed position that overlays the end of the garbage can and to a second open position whereby the garbage can cover is positioned next to the sidewall of the garbage can. When the garbage can is closed by the cover, the first and second plates overlay each other and are in planes that are substantially perpendicular to the axis of the garbage can with the axis of the spring means being substantially perpendicular to the planes of the first and second plates.

11 Claims, 3 Drawing Figures

GARBAGE CAN COVER SPRING CLOSURE

BACKGROUND OF THE INVENTION

1. Field of the Invention

This invention relates generally to garbage closure means and more particularly to an improved hinge for positioning the cover of a garbage can either in a closed position or along the sidewall of the garbage can.

2. Description of the Prior Art

There has been and still is a long standing need for low cost reliable means that will assure the retention of a garbage can cover on a garbage can. In the absence of such means, garbage can covers are frequently lost. Without a garbage can cover securely in place, the contents of the garbage can can be rapidly discharged therefrom either by storm or by small animals. The resultant discharge of litter is both unsanitary and unsightly.

A securely retained garbage can cover is also of considerable importance to the homeowner for reasons in addition to those mentioned hereinabove. Frequently, when a garbage can is being unloaded by sanitation men, the cover is merely dropped on the ground and is not replaced after the garbage can has been emptied. In such instances it is not uncommon for the garbage can cover to become lost or damaged to an extent that makes it unusable. This is of course quite costly to the homeowner who must then replace the entire garbage can.

Many attempts have been made in the past to provide means for securely retaining the garbage can cover on the garbage can. Amongst the several different proposals are clips, latches and springs. However, the prior art attempts at providing a solution to the problems mentioned hereinabove have not been sufficiently successful so as to encourage their widespread use. In many instances the retaining means for the cover of the garbage can are difficult to open and close. Where springs are used they either do not hold the cover tightly on the garbage can or do not securely hold the cover against the garbage can when the garbage can is opened.

SUMMARY OF THE INVENTION

The present invention provides an attachment for positively securing a garbage can cover to a garbage can. In its broadest aspect, the present invention provides a first elongated plate having means integral therewith for gripping the peripheral lip portion of the garbage can cover. A second elongated plate is also provided and includes means integral therewith for gripping an edge portion of the sidewall of the garbage can proximate the open upper end thereof. A hinge is utilized for joining the adjacent ends of the first and second plates that are remote from the garbage can cover and from the body of the garbage can, respectively. An elongated spring that is coupled between the first and second plates proximate their juncture with the garbage can cover the body of the garbage can, respectively, selectively urges the garbage can cover to a first closed position that overlays the open end of the garbage can or to a second open position whereby the garbage can cover is positioned next to the sidewall of the garbage can. When the garbage can cover is in the first, closed position, the first and second plates overlay each other and extend outwardly from the garbage can in planes that are substantially perpendicular to the axis of the garbage can. At this time the axis of the spring will be substantially perpendicular to the planes of the first and second plates. When the garbage can cover and the plate associated therewith are initially pivoted about the hinge axis, the spring will be stretched. After the plate associated with the garbage can cover moves arcuately past the plane of the plate associated with the body of the garbage can, the spring will contract and thereby urge the garbage can cover to the second, open position referred to hereinabove.

Accordingly, it is an object of the present invention to provide improved means for securing a garbage can cover to a garbage can.

It is another object of the present invention to provide means, as described above, wherein a garbage can cover will be securely held in a first position overlaying the open end of the garbage can or in a second position along the sidewall of the garbage can.

It is a further object of the present invention to provide means, as described above, that are positively urged by means of at least one spring to the two aforementioned positions.

Yet another object of the present invention is to provide means, as described above, that may be readily attached to existing garbage cans without the use of special tools and/or skills and without requiring any modification of either the garbage can or the garbage can cover.

A further object of the present invention is to provide low cost means for securing a can cover to a garbage can.

A feature of the present invention is the provision of means for resiliently urging a garbage can cover into either a first position that closes the garbage can or a second position wherein the cover is located along the side of the garbage can.

An advantage of the present invention is that the garbage can be readily opened and closed without separating the cover from the can and be emptied while the cover is in place along the side of the garbage can.

These and other objects, features and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the various figures of the drawings, like reference characters designate like parts. In the drawing.

DESCRIPTION OF THE PREFERRED EMBODIMENT

Figure 1:
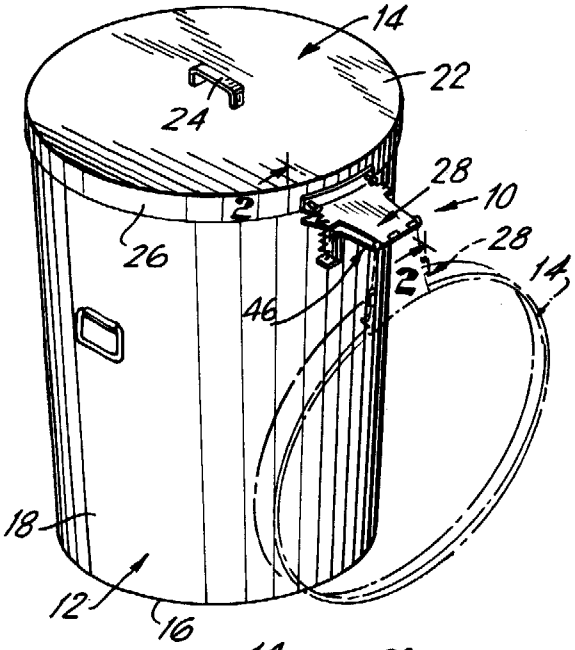
FIG. 1 is a perspective view illustrating the attachment comprising the present invention secured to a garbage can and a garbage can cover.

Referring now to the drawing, and in particular to FIG. 1, there is shown an attachment 10 comprising the present invention secured to a garbage can body 12 and to a garbage can cover 14. The garbage can cover 14 is shown in solid outline in a first closed position and in phantom outline in a second, opened position.

The garbage can body 12 is comprised of a basewall 16, a sidewall 18 extending upwardly therefrom and a peripheral edge portion 20 defining the upper, open end of the body portion 18. The garbage can cover 14 is comprised of an end wall 22 having an integral handle 24 and a peripheral sidewall or lip portion 26 extending downwardly from the end wall 22. It should be noted at this time that the present invention is equally applicable to both plastic and metallic garbage cans and garbage can covers.

Figure 3:
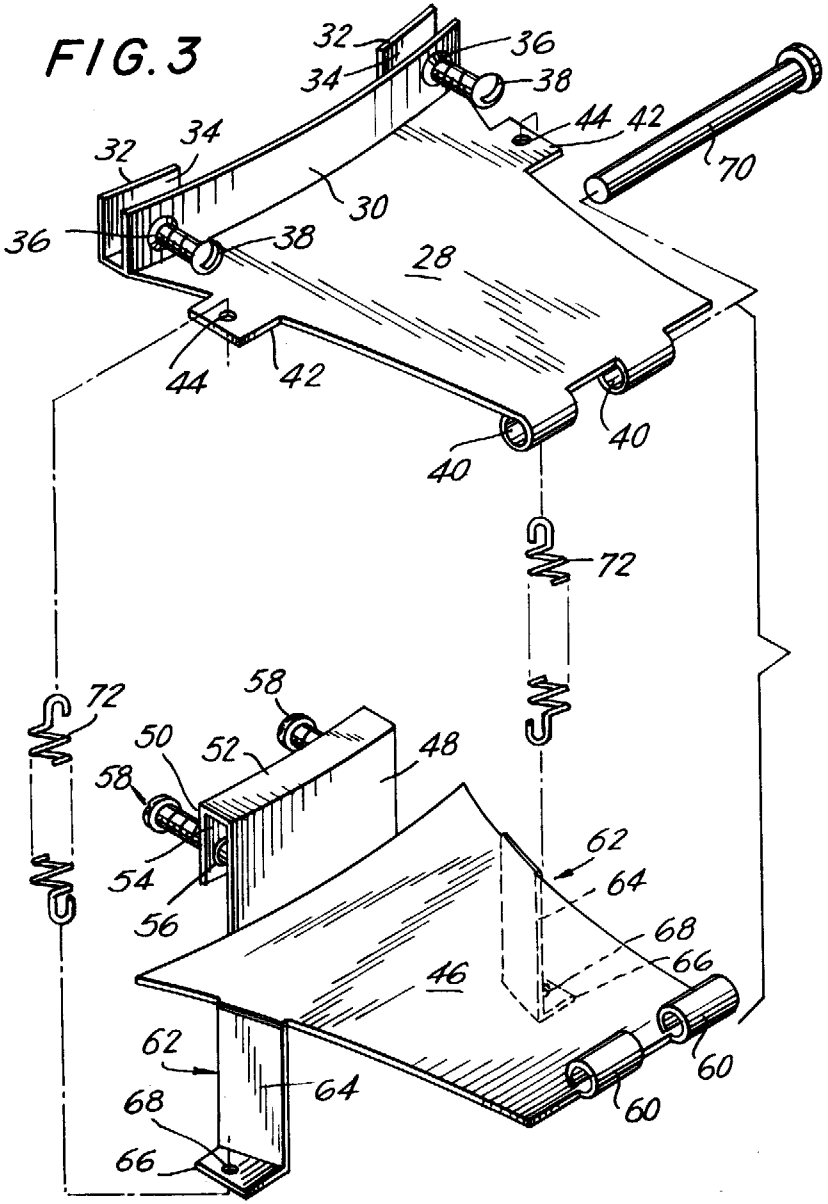
FIG. 3 is an exploded, perspective view illustrating the components of the attachment comprising the present invention.
Figure 2:
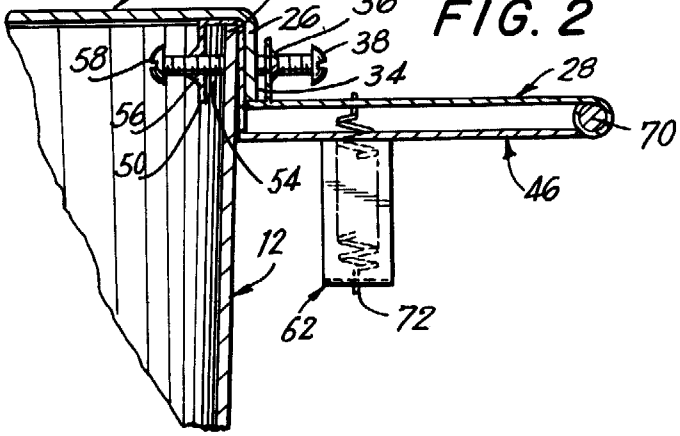
FIG. 2 is a sectional elevational view taken along line 2—2 of FIG. 1.

Turning now more specifically to FIG. 2 and to FIG. 3, it will be seen that the attachment 10 comprising the present invention includes a first plate generally designated by the reference character 28. In the embodiment illustrated the plate 28 is elongated and at one end is provided with a first upstanding wall 30 and a pair of laterally spaced apart second wall sections 32 that, in combination with the first wall 30, define a continuous channel therebetween. A pair of nuts 36 are rigidly secured in and proximate the laterally spaced apart ends of the first wall 30 in order to threadibly receive fasteners 38. The opposite end of the first plate 28 is provided with integral hinge eyes 40. A tab 42 is formed integrally with at least one side edge of the first plate 28 and, in the embodiment illustrated, there is provided a tab 42 for each of the two side edges of the plate 28. A hole 44 is formed in each of the tabs 42.

The attachment 10 comprising the present invention further includes a second plate that is generally designated by the reference character 46 and which includes, at one end thereof, a first integral wall 48, a second wall 50 that is spaced from the first wall 48 and a third wall 52 for connecting the first and second walls 48 and 50, respectively, in order to define a transverse channel 54 therebetween. A pair of nuts 56 are suitably secured to the second wall 50 proximate the laterally spaced apart ends thereof in order to receive fasteners 58. The opposite end of the plate 46 is provided with hinge eyes 60. At least one tab generally designated by the reference character 62 is formed integrally with a side edge of the plate 46 with the tab 62 being comprised of a first leg 64 that is integral with and substantially perpendicular to the plane of the second plate 46. A second leg 66 extends outwardly from and substantially perpendicular to the first leg 64 and is provided with an opening 67. In the embodiment illustrated a tab 62 is provided on each side edge of the plate 46.

The attachment 10 is completed by a hinge pin 70 that couples the hinge eyes 40 and 60 of the first and second plates 28 and 46, respectively, and an elongated spring 72, the ends of which are secured in the holes 44 and 68 of the tabs 42 and 62.

It will be appreciated from the foregoing that the elongated spring 72 will normally urge the garbage can cover to a closed such as is shown in solid outline in FIG. 1 and, when the garbage can cover is raised, will normally urge the garbage can cover 14 to a second position alongside the wall 18 such as is shown in phantom outline in FIG. 1. That is, when the garbage can cover 14 and the plate 28 associated therewith are initially pivoted about the hinge pin 70, the springs 72 will be stretched. After the plate 28 associated with the garbage can cover 14 moves arcuately past the plane of the plate 46 associated with the garbage can body 12, the springs 72 will contract and thereby urge the garbage can cover 14 to the second, open position. It will also be apparent from the foregoing that the attachment 10 may be readily applied to an existing garbage can and garbage can cover without the use of special tools or skills merely by positioning the peripheral lip 26 of the garbage can cover 14 in the continuous channel 34 of the first plate 28 and then tightening the fasteners 38 against the peripheral lip portion 26. The second or lower plate 46 may be similarly secured to the garbage can body 12 by positioning the upper edge 20 thereof in the channel 54 and then tightening the fasteners 58. In this connection it should be noted that the fasteners 38 and 58 are in opposition to the wall portions 32 and 48 of the plates 28 and 46, respectively, so that the attachment 10 may be readily applied and removed. The term "nuts" as regards the reference characters 36 and 56 is used generically herein and includes punched holes having an outwardly flared, internally threaded periphery.

There has been disclosed heretofore the best embodiment of the invention presently contemplated. However, it is to be understood that various changes and modifications may be made thereto without departing from the spirit of the invention.

What is claimed is:

1. An attachment for securing a garbage can cover having a peripheral lip portion to a garbage can having an open end, a basewall in opposition to the open end and a sidewall, said attachment comprising:

a. a first, elongated plate including means at one end thereof for gripping the peripheral lip portion of the garbage can cover;

b. a second elongaged plate including means at one end thereof for gripping an edge portion of the sidewall of the garbage can proximate the open end thereof;

c. hinge means for coupling the opposite end of said first and second plates to each other; and d. at least one elongated spring coupled to said first and second plates for selectively urging said garbage can cover to a first, closed position overlaying the open end of the garbage can whereby said first and said second plates overlay each other and are in planes that are substantially perpendicular to the axis of the garbage can with the axis of said spring being substantially perpendicular to the planes of said first and said second plates, said spring being adapted to selectively urge said garbage can cover to a second, open position, whereby the garbage can cover is positioned next to the sidewall of the garbage can, said spring being stretched when said first plate moves from said first position to a plane that is coincidental with the plane of said second plate, said spring normally contracting when said first plate moves from the plane coincidental with said second plate to said second position.

2. The attachment according to claim 1 said gripping means of said first plate comprises a channel formed integrally therewith for receiving the peripheral lip of the garbage can cover and means cooperating with said channel for retaining said peripheral lip therein.

3. The attachment according to claim 2 wherein said retaining means are fasteners that are in threaded engagement in and through one wall of said channel and which are arranged to bear against the peripheral lip of the garbage can cover.

4. The attachment according to claim 1 wherein said gripping means of said second plate comprises a channel formed integrally therewith for receiving a portion of the sidewall of the garbage can proximate the open end thereof and means cooperating with said channel for retaining the sidewall of the garbage can.

5. The attachment according to claim 4 wherein said retaining means are fasteners in threaded engagement in and through one wall of said channel, said fasteners being arranged to bear against the sidewall of the garbage can proximate the open end thereof.

6. The attachment according to claim 1 wherein the ends of said spring are anchored in said first and second plates proximate the ends thereof that are remote from said hinge means.

7. The attachment according to claim 6 wherein the ends of said spring are anchored proximate confrontingly adjacent side edges of said first and said second plates.

8. The attachment according to claim 6 wherein there are two of said springs.

9. The attachment according to claim 8 wherein the ends of each said spring are anchored proximate each pair of confrontingly adjacent side edges of said first and said second plates.

10. The attachment according to claim 1 wherein said first plate includes at least one laterally extending tab having an opening therein for receiving one end of said spring and said second plate includes at least one tab comprising a first leg extending perpendicularly therefrom and a second leg extending perpendicularly from the ends of said first leg that is remote from said second plate, said second leg of said tab on said second plate including an opening therein for receiving the other end of said spring.

11. The attachment according to claim 10 wherein said first and second plates each include a laterally spaced apart pair of said tabs and there are two of said springs.

* * * * *